US011511327B2

(12) United States Patent
d'Hone et al.

(10) Patent No.: US 11,511,327 B2
(45) Date of Patent: Nov. 29, 2022

(54) CROSS-ROLLING MILL WITH HYDRAULIC ROLLER ACTUATOR

(71) Applicant: SMS group GmbH, Düsseldorf (DE)

(72) Inventors: Frank d'Hone, Cologne (DE); Martin Sauerland, Niederkrüchten (DE); Matthias Krahn, Viersen (DE)

(73) Assignee: SMS group GmbH, Düsseldorf (DE)

( * ) Notice: Subject to any disclaimer, the term of this patent is extended or adjusted under 35 U.S.C. 154(b) by 66 days.

(21) Appl. No.: 17/050,852

(22) PCT Filed: Apr. 24, 2019

(86) PCT No.: PCT/EP2019/060458
§ 371 (c)(1),
(2) Date: Oct. 27, 2020

(87) PCT Pub. No.: WO2019/206958
PCT Pub. Date: Oct. 31, 2019

(65) Prior Publication Data

US 2021/0229147 A1 Jul. 29, 2021

(30) Foreign Application Priority Data

Apr. 27, 2018 (DE) ..... 10 2018 003 434

(51) Int. Cl.
*B21B 19/04* (2006.01)
*B21B 38/10* (2006.01)
(Continued)

(52) U.S. Cl.
CPC ..... *B21B 19/04* (2013.01); *B21B 37/58* (2013.01); *B21B 37/78* (2013.01); *B21B 38/10* (2013.01);
(Continued)

(58) Field of Classification Search
CPC ... B21B 19/02–10; B21B 19/12; B21B 19/16; B21B 37/58; B21B 37/16;
(Continued)

(56) References Cited

U.S. PATENT DOCUMENTS 3,492,850 A * 2/1970 Groppini ..... B21D 3/04 72/98
3,845,646 A 11/1974 Bellmann et al.
(Continued)

FOREIGN PATENT DOCUMENTS

CN 86103262 A 1/1987
CN 102319739 A 1/2012
(Continued)

OTHER PUBLICATIONS

Isamu, Translation of JPS60187415 (Year: 1985).*
(Continued)

*Primary Examiner* — Jessica Cahill
*Assistant Examiner* — Bobby Yeonjin Kim
(74) *Attorney, Agent, or Firm* — Smartpat PLC

(57) ABSTRACT

A cross-rolling mill for rolling a block over a mandrel forms a hollow block. It includes a plurality of working rollers, each of which exerts a substantially radially aligned rolling force onto the block. The working rollers are supported in a roll stand, and the gap between the working rollers and preferably also the alignment of the rolling axis of at least one of the working rollers relative to the block can be modified. Hydraulic actuators, preferably hydraulic capsules, are provided in order to modify the rolling gap and preferably also the alignment of the rolling axis of at least one of the working rollers relative to the block.

17 Claims, 2 Drawing Sheets

(51) Int. Cl.

| | |
|---|---|
| ***B21B 37/58*** | (2006.01) |
| ***B21B 37/78*** | (2006.01) |
| ***B21B 13/00*** | (2006.01) |
| ***B21B 19/06*** | (2006.01) |

(52) U.S. Cl.
CPC ..... *B21B 13/008* (2013.01); *B21B 19/06* (2013.01); *B21B 2271/04* (2013.01)

(58) Field of Classification Search
CPC ..... B21B 37/62; B21B 37/78; B21B 31/32; B21B 38/10; B21B 38/105
USPC ..... 72/95–100
See application file for complete search history.

(56) References Cited

U.S. PATENT DOCUMENTS

| | | | |
|---|---|---|---|
| 4,506,531 | A | 3/1985 | Sakurada et al. |
| 4,821,544 | A | 4/1989 | Tarnier et al. |
| 5,295,379 | A | 3/1994 | Trbovich et al. |
| 2002/0000113 | A1 | 1/2002 | Hoffgen et al. |
| 2007/0036426 | A1 | 2/2007 | Kubota et al. |
| 2014/0216121 | A1 | 8/2014 | Haverkamp |
| 2015/0000363 | A1 | 1/2015 | Cernuschi et al. |
| 2020/0065995 | A1 | 2/2020 | Shivaram et al. |

FOREIGN PATENT DOCUMENTS

| | | | | |
|---|---|---|---|---|
| CN | 103962394 | A | 8/2014 | |
| CN | 204486475 | U | 7/2015 | |
| CN | 204503779 | U | 7/2015 | |
| CN | 104324944 | B | 10/2016 | |
| DE | 2156595 | A1 | 5/1973 | |
| DE | 3530343 | A1 | 2/1987 | |
| DE | 3619412 | A1 | 12/1987 | |
| DE | 19805602 | A1 | 8/1999 | |
| DE | 102005042835 | | 5/2007 | |
| DE | 102011078623 | A1 | 1/2013 | |
| DE | 102016114337 | A1 | 2/2017 | |
| DE | 102016114377 | A1 | 3/2017 | |
| EP | 1679137 | A1 | 7/2006 | |
| EP | 2590761 | A2 | 5/2013 | |
| JP | S60187415 | * | 9/1985 | ..... B21B 37/78 |
| JP | S60187415 | A | 9/1985 | |
| JP | S60206514 | A | 10/1985 | |
| JP | S60261607 | A | 12/1985 | |
| JP | S613608 | * | 1/1986 | ..... B21B 37/78 |
| JP | S61209706 | A | 9/1986 | |
| JP | S61276708 | A | 12/1986 | |
| JP | S62173014 | A | 7/1987 | |
| JP | S63289405 | A | 11/1988 | |
| JP | 105185117 | A | 7/1993 | |
| JP | H05177221 | A | 7/1993 | |
| JP | 2017024038 | A | 2/2017 | |

OTHER PUBLICATIONS

Tomio, Translation of JPS613608 (Year: 1986).*

Tenaris starts advanced seamless pipe production for the demanding US oil and gas industry, Authors: Michael Wilms, Publication data: Mpt. Metallurgical Plant and Plant and Technology International,,Feb. 20, 2018,VERLAG Stahleisen, Duesseldorf, DE, Source info: vol. 1, Nr: 2, pp. 44-47.

* cited by examiner

CROSS-ROLLING MILL WITH HYDRAULIC ROLLER ACTUATOR

TECHNICAL FIELD

The disclosure relates to a cross-rolling mill for rolling a block over a mandrel so as to form a hollow block. The disclosure additionally relates to a method for producing a hollow block out of a block using such a cross-rolling mill.

BACKGROUND

When rolling a metallic hollow block over a mandrel by means of the so-called "Mannesmann process," a preheated block, in the case of steel a block preheated to approximately 1,250° C., is rolled so as to form a hollow block by means of two or more main working rollers over a mandrel located between the rollers. During the rolling process, the working rollers exert a substantially radially aligned rolling force onto the block and are mounted and supported in a roll stand, a so-called "mill stand," in such a manner that at least the rolling gap between the working rollers can be adjusted to the desired wall thickness of the hollow block to be produced. For decades, mechanical spindle drives have been used for this purpose; these allow at least one adjustment of the rolling gaps prior to and after the rolling process. Nevertheless, it is not possible to adjust the rolling gap during the rolling process, in particular not to adjust the rolling gap automatically during the rolling process itself.

SUMMARY

As such, it is an object of the disclosure to specify a cross-rolling mill along with a method for rolling a block over a mandrel so as to form a hollow block, by means of which the problems known from the prior art are solved and preferably an automated compensation of disturbance variables that is determined during the rolling process is enabled.

This object is achieved with a cross-rolling mill comprising the features as disclosed herein and a method comprising the features as disclosed herein.

In accordance with a first aspect, a cross-rolling mill for rolling a block over a mandrel to form a hollow block is specified, with which, instead of the mechanical actuators previously used, such as spindle drives, hydraulic actuators, preferably hydraulic capsules, are provided to modify the rolling gap, preferably also the alignment of the rolling axis of at least one of the working rollers relative to the block. The modification of the rolling gap by means of hydraulic actuators with respect to the block as workpiece is understood to mean that the working rollers are realigned with respect to each other as required, by which the dimension and geometry of the rolling gap remain variable even during the rolling process. During the rolling process, an alignment is thus carried out relative to the block to be formed so as to form a hollow block, between the respective rolling processes and during the rolling processes, the alignment of at least one of the rolling axes is therefore also or alternatively carried out relative to the other working roller(s). Thereby, the hydraulic actuators are preferably connected in a manner customary in the industry with chocks, by means of which the working rollers are adjustably mounted in the respective roll stand.

This makes available the first cross-rolling mill that, on the basis of the hydraulic actuators, allows a modification to the rolling gap geometry or any other type of compensation for disturbance variables even during the rolling process.

The working rollers are pre-adjusted to a certain distance relative to each other, the so-called "rolling gap," by means of the hydraulic actuators. In the cross-rolling mill, the mandrel held by a mandrel bar is located symmetrically between the working rollers, over which the block is then rolled so as to form a hollow block. Based on the inclined position of the working rollers, the block is formed so as to form a hollow block via the mandrel, which is arranged in a fixed manner in the rolling gap, and due to the propulsion applied to the block by the inclined position of the working rollers.

During rolling, however, enormous forces are generated that, among other things, push the working rollers apart. The shape of the entire mill stand is extended or otherwise distorted by the forces acting on the working rollers, which ultimately leads to a modification in the previously adjusted rolling gap and its geometry.

Typically, the working rollers, for example the upper and lower working roll, move different distances in different spatial directions. This is all the more true if one or more of the working rollers are firmly connected to the roll stand and/or the foundation, and are therefore only subject to minimal movement under load. In this case, the previously set arrangement of both the working rollers and, if necessary, the mandrel is lost. As a result, the rolling gap increases and the symmetry of the arrangement of the working rollers and, if necessary, the mandrel is shifted relative to each other, in particular since, for example, the upper and lower working rollers are shifted differently, for example upwards or downwards, depending on the design. Ultimately, the center of the working rollers is shifted towards each other and towards the mandrel and thus towards the outlet side of the cross-rolling mill, which leads to undesired effects on the quality of the hollow block produced. In the distribution of the wall thickness of the hollow block, the shifting of the working roller centers relative to each other results in increased eccentricities, which are ultimately still to be found in the finished rolled tube.

Up to now, such disturbance variables could only be determined after the end of the rolling process and compensated for by readjusting the working rollers relative to each other prior to a subsequent rolling process. Dynamic compensation for disturbance variables, in particular compensation for control variables during the rolling process on the basis of measured data determined online, has not been possible until now. The use of hydraulic actuators overcomes this disadvantage of existing cross-rolling mills.

The use of hydraulic actuators, preferably hydraulic capsules, enables the dynamic minimization or complete compensation of the stand expansion and the associated shifting of the roller position relative to each other. In particular, it is made possible for the first time, even under changing load conditions (for example, during rolling), to compensate for the disturbance variables of the rolling gap modifications and rolling gap shifts, preferably in real time, by suitable modifications to the rolling gap, preferably also of the alignment of the rolling axis of at least one of the working rollers with respect to the block or any other working roller, preferably to the greatest possible extent.

The control variables are preferably disturbance variable regulators for the hydraulic actuators of the working rollers, which act in the x-direction transversely to the rolling direction, in the y-direction vertically to the rolling direction and in the z-direction in the rolling direction towards the outlet side.

Preferably, in accordance with the first aspect, the cross-rolling mill has, in addition to the working rollers, preferably the upper and lower working rollers, disks or guide shoes which laterally limit the rolling gap and by means of which a central positioning of the block and the outgoing hollow block within the rolling gap can be influenced. Such so-called "Diescher disks" typically have a circumferential profile in the shape of the hollow block to be rolled, and are arranged within the cross-rolling mill so that they can be adjusted relative to the hollow block. In this connection, it is preferred if the Diescher disks or the guide shoes also have hydraulic adjustment elements that preferably support or can effect a compensation for disturbance variables that acts on a dynamic and online basis.

In a further preferred embodiment of the cross-rolling mill, a measuring device is provided, with which a modification in the rolling gap geometry and/or the rolling gap shift and/or the position of the working rollers in space along with their modification during the rolling operation can be determined. In this connection, it is particularly preferable if such measuring device is connected to an evaluation unit, which is suitable for determining the disturbance variables to be compensated for. This provides a cross-rolling mill that is capable of determining dynamically and permanently preferably any modification in the rolling process, for example on the basis of a stand expansion to be measured and the associated modification in the arrangement of the working rollers and, if necessary, the mandrel relative to each other. In principle, the measuring device can be arranged at any point of the roll stand or its built-in elements, wherein a substantially direct measurement at the working rollers is preferred, while an indirect measurement, for example at a guide element such as a Diescher disk or a guide shoe, nevertheless also permits a conclusion to be drawn regarding the position of the working rollers or the individual guide elements in the roll stand under load by means of a corresponding observation of the correlation.

It is particularly preferable if the measuring device includes an optical image acquisition unit, which makes it possible to separate the measuring unit away from the roll stand and the circumstances that would otherwise act on the measuring unit there and disturb the measuring result. It is particularly preferable if the measuring device includes a camera, preferably a CCD camera. By means of such a camera, the measuring unit in the rolling mill can be positioned almost arbitrarily at the roll stand and at the same time, if necessary after a corresponding calibration, can provide all desired measuring results.

In this connection, it is particularly preferable if the measuring device is capable of recording an image element connected to the roll stand, preferably one or more image elements connected to the actuators for the working rollers, and is then capable of determining their position and/or shape modifications during the rolling process. In this connection, it is particularly preferable if the at least one image element is an active luminous element, which is circular in a highly preferred embodiment of the invention and is formed with a defined diameter or is oval with a defined shape. It is also preferred if the image element is square or rectangular, wherein, in this case, for example, the evaluation of the modification to one or more image element diagonals under load allows an indication of the roll stand expansion or distortion.

On the one hand, this creates the possibility of measuring every roll stand expansion and/or distortion directly and immediately; on the other hand, the design of the image element as an active luminous element advantageously supports image acquisition with particularly simple means. Finally, the preferred design of the image element with a circular shape and defined diameter or oval with a predetermined shape or square or rectangular with known diagonal dimensions, on the one hand, supports the calibration of the measurement with particularly simple means, and on the other hand creates the possibility of recording not only the modification in position of the image element during the roll stand expansion, but also any modification in shape of the image element on the basis of any other type of distortion of the roll stand. This becomes particularly advantageous if the optical image acquisition is able to record not only the center point (in case of a circular shape) or the intersection of the main axes (in case of an oval shape) or the intersection of the diagonals of the surface (in case of a square or rectangular shape) of an image element, but its entire surface, or at least the edge of the image element and its center. The advantage of such measuring method is that it creates the possibility of evaluating many points of the flat image element to determine a single point. This reduces the susceptibility to interference compared to a conventional laser measurement, which only allows a single point to be evaluated. In addition, the surface evaluation allows a one-time calibration of the measuring device independent of its location; the position of the measuring device can thus be freely selected and even modified from one measurement to the next where necessary.

In accordance with a second aspect, a method for producing a hollow block out of a block by means of a cross-rolling mill is provided for rolling a block over a mandrel, particularly preferably a cross-rolling mill according to the first aspect. Hydraulic actuators, preferably hydraulic capsules, which are directly or indirectly connected to the working rollers, for example via roll chocks, modify the rolling gap during the rolling process, preferably also the alignment of the rolling axis of at least one of the working rollers with respect to the block. This provides a method that, for the first time, makes it possible to undertake modifications to the rolling gap geometry during the rolling process, and thus to counteract any disturbance variables determined for the purpose of quality assurance or optimization of the rolling process.

It is particularly preferable if the modification to the rolling gap, as described above, is effected if disturbance variables have been previously determined by an evaluation unit by means of measured modifications to the rolling gap geometry and/or the rolling gap shift and/or the position of the working rollers in space along with their modification during the rolling operation. It is then particularly advantageous to output a signal for compensation of the control variables to the hydraulic actuators in conjunction with a suitable control and regulation unit and the evaluation unit.

In this connection, it is particularly preferable if the evaluation unit is connected to a measuring device, preferably an optical measuring device arranged at a distance from the roll stand, in particular a measuring device with an optical image acquisition unit. In a preferred embodiment, such measuring device can record an image element connected to the roll stand, preferably one or more image elements connected to the actuators for the working rollers, and can determine their position and/or shape modifications during the rolling process. The movement of the image elements is preferably dynamically recorded with high accuracy by means of the optical measuring device, wherein the modifications $\Delta x\mathbf{1}(t)$ and $\Delta y\mathbf{1}(t)$ of the upper working roll or $\Delta x\mathbf{2}(t)$, $\Delta y\mathbf{2}(t)$ of the lower working roll, as the case may be, are preferably determined online and transmitted by means of the evaluation unit to the control and regulation unit for minimizing or compensating for the control variables. Preferably, new control variables for the hydraulic actuators of the upper working roll and/or the lower working roll are then calculated online using suitable algorithms, and the respective roll positions are adjusted in such a manner that the absolute rolling gap error is minimized and the symmetry to the original center can be restored.

This provides a method that allows a very precise and highly dynamic compensation of disturbance variables with means that are simple and interference-immune and accurate and usable online, by which, for the first time, an influence on the currently ongoing rolling operation can be exerted during the rolling process in the cross-rolling mill.

For this purpose, it is also advantageous if, in addition to the position of the working rollers, preferably the upper and/or lower working rollers, also or exclusively the position and/or location of the mandrel as well as, in addition thereto or independently of other modifications, the position and/or location of the Diescher disks in relation to the block or hollow block is dynamically modified, in order to effect or at least support the compensation of previously determined disturbance variables.

As a whole, this enables, in accordance with both of the aspects explained in more detail above, dynamic compensation of the expansion of the rolling mill during rolling and the reduction or elimination of defects in the tube to be produced by the cross-rolling mill. The measured values are preferably recorded without contact and at a distance from the roll stand, thus free from the influences near the rolling gap that disturb the measuring result, and allows the highest possible flexibility in the arrangement of the measuring device to the roll stand depending on local conditions. During the rolling process, movements of the roll stand can be recorded and compensated for during subsequent rolling, if necessary also during the ongoing rolling process. To record the data required for compensation, measurements can be taken at several points at the same time; the measuring device can also be permanently mounted or mobile.

For the measurement, an optical image acquisition system, which uses the CaliView® measuring instrument, can be used in a highly preferred manner. It can measure contours from a distance of 8 m to 40 m with an accuracy of 0.1 mm, wherein CaliView® also has a serial image function for checking the measurement.

The measurement can thus record movements of the roll stand determined during the rolling process and the resulting modifications in the rolling gap and rolling gap geometry, and use them during operation to readjust the working rollers or other control variables. Due to the preferably known shape and dimension of the image element on the roll stand, when the measuring device is arranged in relation to the roll stand, an angular offset can also be provided, which should then be taken into account when calibrating the measuring device. In this manner, the influence of the vapors arising during the cross-rolling process and other influences disturbing the measurement result can be limited to the unavoidable minimum.

DETAILED DESCRIPTION

Figure 1:
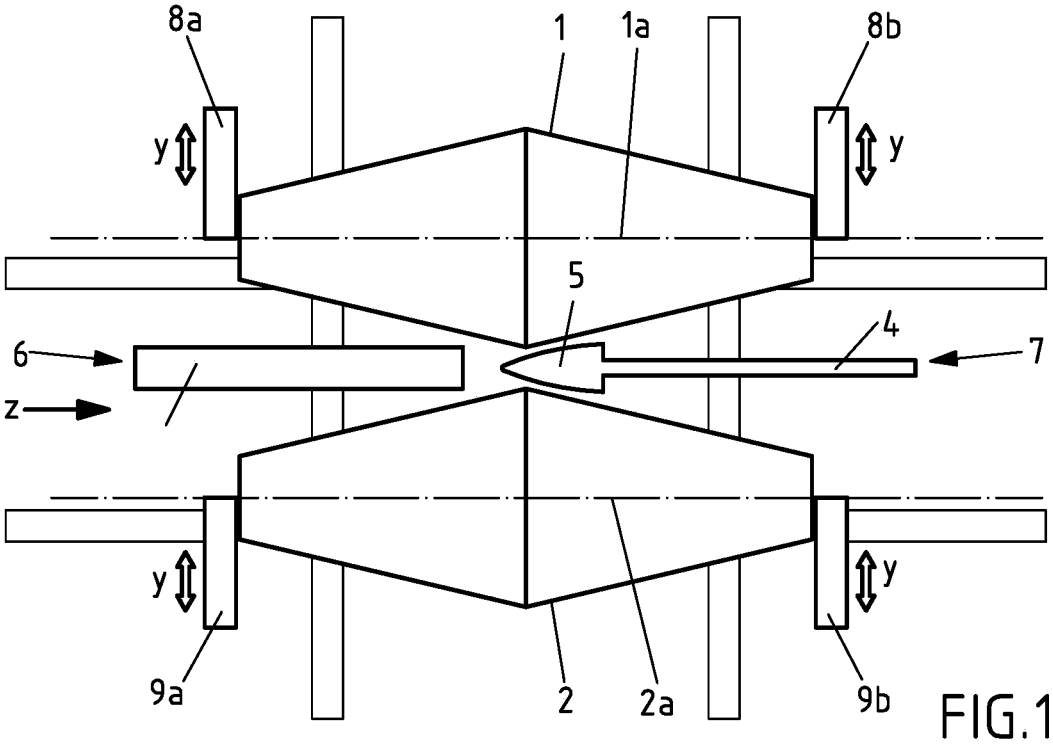
FIG. 1 shows a schematic view of a part of a cross-rolling mill in accordance with a first embodiment.

FIG. 1 shows in a first embodiment the mode of operation of a cross-rolling mill, comprising an upper working roller 1 and a lower working roller 2. The upper and lower working rollers 1, 2 are designed in the form of two truncated cones connected to each other at their large end faces and work together with a mandrel 5 arranged on a mandrel bar 4 during the forming of a block 3 in a direction from left to right (z-direction) in FIG. 1. Upon the suitable adjustment of the upper and lower working rollers 1, 2 relative to the block 3, the block 3 is conveyed from the entry side 6 to the exit side 7 by rotation of the upper and lower working rollers 1, 2 about their longitudinal axes 1*a* and 2*a* respectively through the rolling gap between the upper and lower working rollers 1, 2 and over the mandrel 5. At the respective ends of the upper and lower working rollers 1, 2, there are hydraulic actuators 8*a*, 8*b*, and 9*a*, 9*b*, by means of which the position of the working rollers 1, 2 relative to each other and in relation to the block 3 can be modified almost at will, in particular in the manner shown in a y-direction in a manner vertical to the rolling direction. By means of the vertical adjustment of the hydraulic actuators 8*a*, 8*b*, 9*a*, 9*b*, the rolling gap between the upper and lower working rollers 1, 2 can also be modified at least both in the y-direction and in the z-direction.

Figure 2:
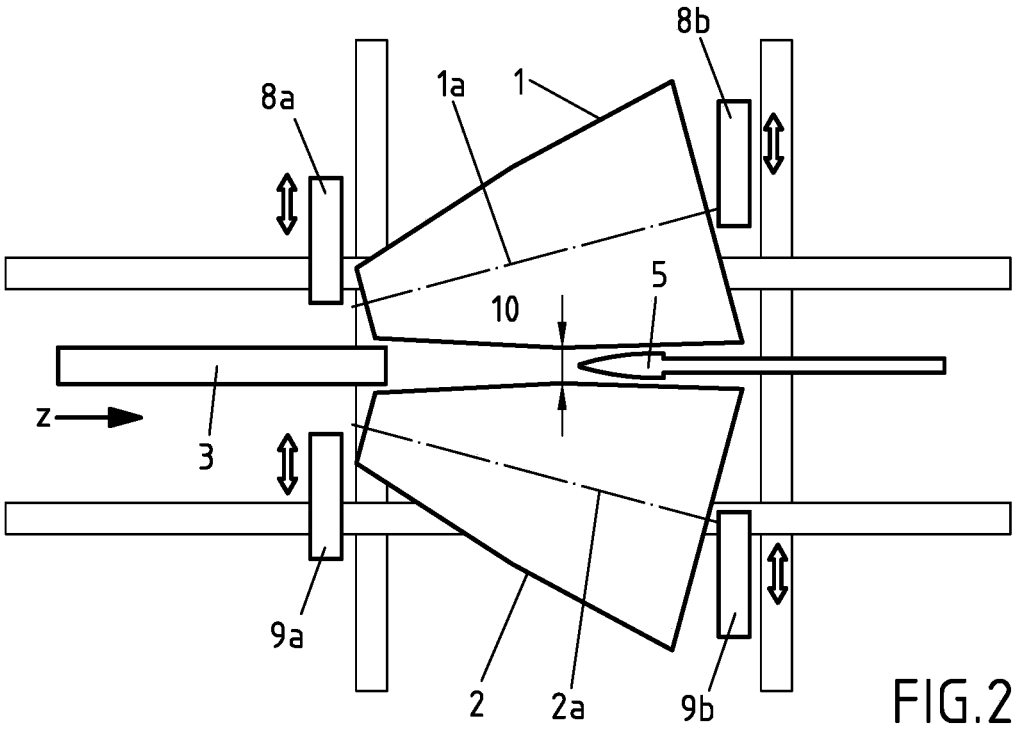
FIG. 2 shows a schematic representation of a part of a cross-rolling mill in accordance with a second embodiment.

FIG. 2 shows an additional embodiment of an essential part of a rolling mill, comprising an upper working roller 1 along with a lower working roller 2, each of which shows a truncated cone shape with a discontinuous shell profile. Between the upper and lower working rollers 1, 2, there is in turn a rolling gap 10, into which the block 3 enters by movement in the direction z towards the mandrel 5 and is formed there into a hollow block (not shown) in cooperation of the upper and lower working rollers 1, 2 with the locally fixed piercing mandrel 5. At both ends of the upper and lower working rollers 1, 2, there are hydraulic actuators 8*a*, 8*b* and 9*a*, 9*b* respectively, by means of which a modification to the rolling gap 10 and the local position of the rolling axes 1*a*, 1*b* can be effected.

Figure 3:
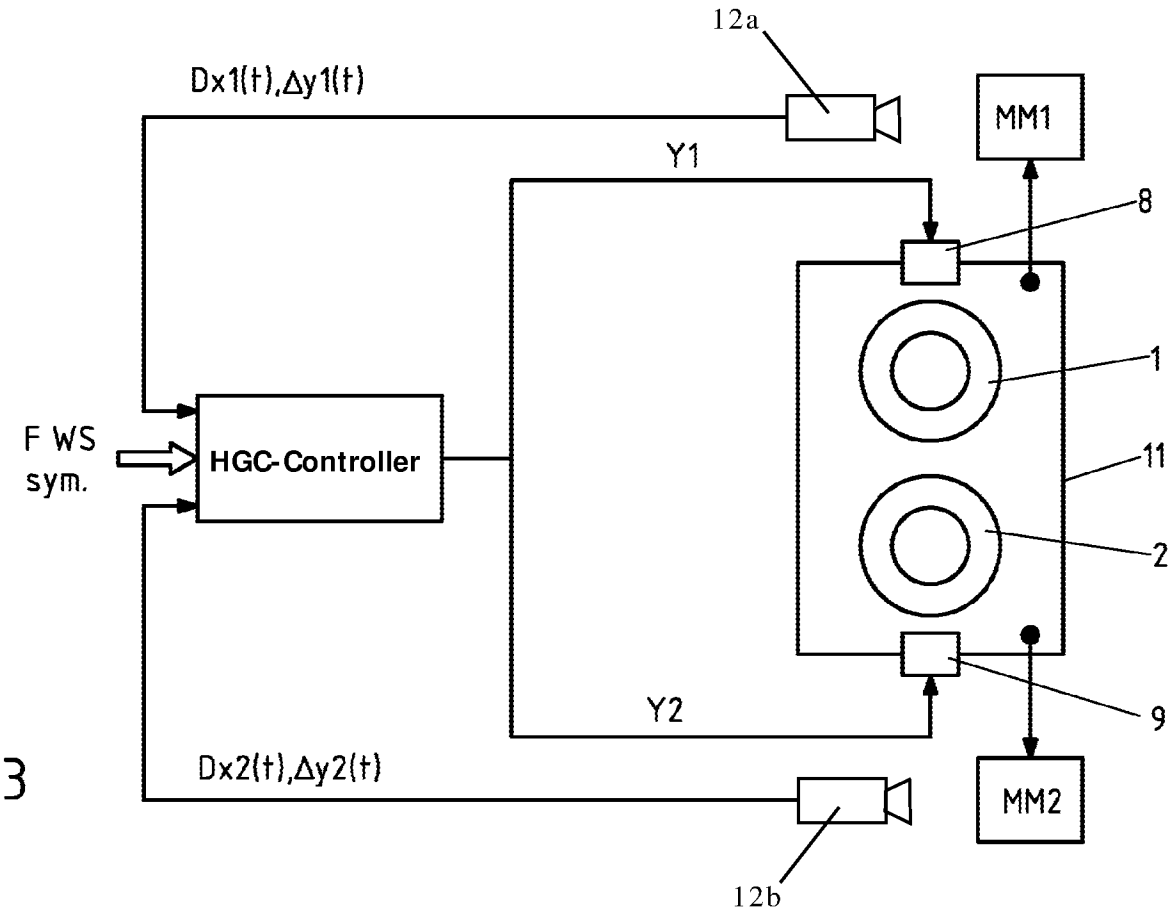
FIG. 3 shows a flow chart for the application of a method in accordance with the disclosure.

FIG. 3 shows a schematic flowchart of the method for producing a hollow block by means of a cross-rolling mill 11, which carries an upper working roller 1 and a lower working roller 2. Image elements MM1 and MM2 are arranged on roll housings of the roll stand 11 and are permanently monitored during the rolling operation with high accuracy and dynamically, both with regard to their position and their shape by a camera (12*a*, 12*b*) arranged at a distance. Each modification to position in the x-direction and the y-direction $Dx1(t)$, $\Delta y1(t)$ for the upper working roller 1 and $Dx2(t)$, $\Delta y2(t)$ for the lower working roller 2 is recorded by the measuring unit (not shown) and transmitted to an evaluation unit (also not shown). In such evaluation unit, it is determined whether the positional modifications to the image elements MM1, MM2 recorded by the camera (12*a*, 12*b*) are to be considered as control variables to be compensated for. If this is the case, the disturbance variables determined by the evaluation unit are forwarded to the HGC regulator as a control and regulation unit (hydraulic gap control regulator). Further process parameters are entered into the control and regulation unit (HGC), such that control commands Y1, Y2 are issued to the hydraulic actuators 8, 9 on the basis of previously defined algorithms. By adjusting the upper working roller 1 and/or the lower working roller 2 relative to the mandrel (not shown), such hydraulic actuators 8, 9 modify the rolling gap geometry and, if necessary, the alignment of the rolling axes (not shown) relative to each other. This makes it possible to output control and regulation commands online during the rolling process in a highly dynamic manner with constant acquisition and evaluation of measurement data, which commands are able to positively influence the rolling result and the course of the cross-rolling process.

LIST OF REFERENCE SIGNS

1 Working roller
1*a, b* Rolling axis
2 Working roller
2*a, b* Rolling axis
3 Block
5 Mandrel
8 Actuator
8*a*, 8*b* Actuator
9 Actuator
9*a*, 9*b* Actuator
10 Rolling gap
11 Cross-rolling mill
HGC Hydraulic gap control
MM1 Image element
MM2 Image element
12*a*, 12*b* Camera

The invention claimed is:

1. A cross-rolling mill for rolling a block over a mandrel so as to form a hollow block, comprising:
a roll stand;
a plurality of working rollers supported in the roll stand, each of which exerts a substantially radially aligned rolling force onto the block;
hydraulic actuators configured to modify a rolling gap between the plurality of working rollers;
a mandrel arranged between the working rollers; and
a controller operatively connected to the hydraulic actuators, the controller being configured to modify the rolling gap while the block is rolled over the mandrel.

2. The cross-rolling mill according to claim 1,
wherein the hydraulic actuators are hydraulic capsules, and
wherein the hydraulic capsules are configured to modify an alignment of a rolling axis of at least one of the plurality of working rollers relative to the block.

3. The cross-rolling mill according to claim 1,
wherein the hydraulic actuators are capable of compensating for a roll stand expansion during rolling operation by modifying an adjustment of the working rollers relative to one another.

4. The cross-rolling mill according to claim 1,
further comprising disks and/or guide shoes which laterally limit the rolling gap and which are connected to hydraulic actuators.

5. The cross-rolling mill according to claim 1,
further comprising a measuring device with which a modification in a rolling gap geometry and/or a rolling gap shift and/or a position of the working rollers in space along with their modification during rolling operation can be determined.

6. The cross-rolling mill according to claim 5,
wherein the measuring device includes an optical image acquisition unit.

7. The cross-rolling mill according to claim 5,
wherein the measuring device is capable of recording at least one image element connected to the roll stand and of determining a change in position and/or shape of the at least one image element.

8. The cross-rolling mill according to claim 7,
wherein the at least one image element is an active luminous element.

9. The cross-rolling mill according to claim 7,
wherein the at least one image element is circular with a defined diameter, or square or rectangular with known diagonal dimensions, or oval with a defined shape.

10. The cross-rolling mill according to claim 1,
wherein the controller is connected to the hydraulic actuators in such a manner that previously determined modifications in a rolling gap geometry and/or a rolling gap shifting and/or a position of the working rollers in space along with their modification during rolling operation can be counteracted by modifying the rolling gap.

11. The cross-rolling mill according to claim 1,
wherein a position of the mandrel can be modified within the rolling gap.

12. A method for producing a hollow block using a rolling process, comprising:
providing a cross-rolling mill with a plurality of working rollers, each of which exerts a substantially radially aligned rolling force onto the block;
supporting the plurality of working rollers in a roll stand such that a rolling gap between the plurality of working rollers can be modified by hydraulic actuators;
rolling the block over a mandrel; and
modifying the rolling gap during rolling the block over the mandrel.

13. The method according to claim 12, further comprising
measuring, with a camera, a change to a rolling gap geometry and/or a rolling gap shift and/or a position of the working rollers in space along with their changes during rolling operation.

14. The method according to claim 13,
wherein a controller is connected to the camera and outputs signals for compensating disturbance variables to the hydraulic actuators.

15. The method according to claim 13,
wherein the camera is arranged at a distance from the roll stand.

16. The method according to claim 15,
wherein the camera records an image element connected to the roll stand and determines its position and/or shape changes during the rolling process.

17. The method according to claim 13,
wherein a position and/or alignment of the mandrel within the rolling gap is modified during the rolling process to compensate for previously determined disturbance variables.

* * * * *